United States Patent [19]

de Roure

[11] Patent Number: 4,637,516

[45] Date of Patent: Jan. 20, 1987

[54] WOUND COIL OF TIE MATERIAL PACKAGED ON A DISPLAY BASE, AND A PROCESS FOR PRODUCING IT

[75] Inventor: Olivier P. R. de Roure, Rougemont le Chateau, France

[73] Assignee: Manufacture de Rougement, Paris, France

[21] Appl. No.: 672,482

[22] Filed: Nov. 16, 1984

[30] Foreign Application Priority Data

Nov. 23, 1983 [FR] France ..... 83 18672

[51] Int. Cl.[4] ..... B65D 73/00; B65D 85/04

[52] U.S. Cl. ..... 206/471; 206/409; 206/497; 206/461; 53/427; 53/410; 242/159; 242/171; 242/172

[58] Field of Search ..... 206/471, 461, 409, 407, 206/497, 410, 225; 242/159, 171, 172; 83/649; 53/427, 430, 410

[56] References Cited

U.S. PATENT DOCUMENTS

| | | | |
|---|---|---|---|
| 1,922,969 | 8/1933 | MacColl | 206/410 |
| 2,912,805 | 11/1959 | Maynard, Jr. | 53/427 |
| 3,246,814 | 4/1966 | Lorell et al. | 206/457 |
| 3,253,705 | 5/1966 | Stoker, Jr. | 206/471 |
| 3,313,194 | 4/1967 | Hanscom | 206/461 |
| 3,402,810 | 9/1968 | Percelay | 206/461 |
| 3,507,383 | 4/1970 | Rorer | 53/427 |
| 3,512,634 | 5/1970 | Burch, Jr. | 206/409 |
| 3,700,185 | 10/1972 | Hubbard et al. | 242/172 |
| 3,756,399 | 9/1973 | Cosier et al. | 53/427 |
| 4,111,089 | 9/1978 | Montaruli | 83/649 |
| 4,467,916 | 8/1984 | Hedden et al. | 242/172 |

FOREIGN PATENT DOCUMENTS

| | | | |
|---|---|---|---|
| 2044726 | 3/1972 | Fed. Rep. of Germany | 53/427 |
| 0092626 | 11/1983 | France . | |
| 7510786 | 12/1975 | Netherlands . | |
| 2085404 | 4/1982 | United Kingdom . | |

*Primary Examiner*—William Price
*Assistant Examiner*—Brenda J. Ehrhardt
*Attorney, Agent, or Firm*—Berman, Aisenberg & Platt

[57] ABSTRACT

Unlike display bases of the blister type of the prior art, the coil (1) is packaged on a display base (3) with a thin plastic film (14) which matches all the visible surfaces of the coil. This film (14) cooperates with the display base (3) both in the zone (15) inside the coil and in the zone (11) outside the latter. If cutting means (7) are also provided on the display base, the film (14) (as shown at 12) completely envelops the cutting means (7) without it being necessary to use additional fastening means. The inner end (10) of the tie material passes through a hole (9) in the film (14) and thus can be pulled for controlled unwinding due to a braking action caused by the at least partial adherence of the film to the turns of the coil. Packaging of this kind can be achieved by a single-stage process in the course of which a stretched and heated film is applied to a porous substrate carrying the coil and optionally the cutting means (7). The end (10) of the tie material is then shaped to pierce the film (14) at (9).

13 Claims, 5 Drawing Figures

WOUND COIL OF TIE MATERIAL PACKAGED ON A DISPLAY BASE, AND A PROCESS FOR PRODUCING IT

BACKGROUND OF THE INVENTION

1. Field of the invention

The present invention relates to a wound coil of tie material packaged on a display base, and a process for producing it. In the following description the wound coil of tie material will be called a "bobbin" and a wound coil of tie material means a wound coil of wire tie material.

1. Description of the Prior Art

At the present time numerous products packaged on display bases in the form of cards are sold in commerce. These display bases are usually of cardboard, plastic material, cardboard coated with plastic material, and the like. At the top they generally have a perforation enabling them to be easily hung on any suitable support. The products attached to such display bases are encapsulated in a sheath of plastic material which is bonded or otherwise fixed to the card. When a user wishes to gain access to the packaged product, he must tear or pull off the sheath of plastic material. This entails no major disadvantages for certain objects for immediate use, such as, for example, electric bulbs or batteries, but it does constitute a serious drawback for articles intended for prolonged use, such as a wound coil of tie material or bobbin. A bobbin of this kind is, for example, a coil of flexible wire coated with plastic material. This flexible plastic-coated wire is used for ties or fasteners for many purposes: in the house, for example, for closing bags, in the garden for fastening a stake or branches, in the workshop for fastening numerous objects, and for other purposes.

The tie is cut to the required length with the aid of a cutting tool.

It will readily be understood that if the protective sheath attached to the display base is torn off, the bobbin will unwind in a disorderly manner and a great length of tangled wire will thus be obtained.

The bobbins are usually sold with great lengths of wire, for example about 25 meters.

Two main types of packaged bobbins are known: bobbins contained in rigid shells and bobbins encapsulated in semirigid sheaths.

Thus, bobbins packaged at the present time on a display base with a rigid shell are, for example, disposed in a receptacle or cover of rigid plastic material which after opening does not ensure satisfactory unwinding of the wire, since its unwinding is uncontrolled. In addition, the cost of the display base is rather high.

Rigid shells may be of the refillable or discardable type.

Other bobbins on the market are encapsulated either completely or partially in a semirigid sheath. The major disadvantage of semirigid sheaths, the cost price of which is lower than that of rigid shells, is that, whatever the sheath is made, the wire becomes entangled and leads to the formation of kinks when it unwinds. After a certain number of applications the wire thus becomes unusable.

Prior art bobbins are also usually supplied complete with a cutting tool. The cutting tool has fastening means, for example eyelets, enabling it to be riveted to the display card. In certain cases the cutting tool is riveted directly to one of the parts of the shell of plastic material. All these operations take time and their cost is substantial.

GENERAL DESCRIPTION OF THE INVENTION

The present invention provides a bobbin of simple construction which overcomes the drawbacks of the prior art and, while inexpensive, permits controlled unwinding of the wire.

The present invention provides also process which makes it possible, in a single stage, to package on a display base a wound coil of tie material and, optionally, associated cutting means, while achieving improved unwinding properties.

The present invention therefore provides a wound coil of tie material packaged on a display base in the form of a card, the coil being held in place and surrounded by a protective sheath, wherein the sheath consists of a thin, flexible film matching the shape of all the visible surfaces of the coil and cooperating with the display base both in the zone situated inside the coil and in the zone situated outside the latter, the said film being continuous except for a hole provided for the passage of the end of the tie material in the coil, thus permitting controlled unwinding of the wire from the inside of the coil because of the braking action caused by the at least partial adherence of the film to the turns of the coil.

In another aspect, the invention relates to a wound coil of tie material packaged on a display base in the form of a card, the wound tie material being held in place and surrounded by a protective sheath, the said display base being in addition provided with means for cutting the tie material at the outlet of the coil, wherein the sheath is composed of a thin, flexible film matching the shape of all the visible surfaces of the coil and at the same time cooperating with the said cutting means and with the display base both in the zone situated inside the coil and in the zone situated outside the latter, the said film being continuous except for a hole provided for the passage of the end of the tie material in the coil, thus permitting, in combination, the holding in position of the cutting means on the display base without other fastening means and the controlled unwinding of the wire from the inside of the coil because of the braking action caused by the at least partial adherence of the film to the turns of the coil.

The present invention also relates to the following characteristics, considered singly or in any technically possible combination:

the protective sheath is a film of plastic material of a thickness of about 80 microns;

the protective sheath is of polyethylene;

the wound coil of tie material is combined on the display card w:th a cutting tool fixed and completely covered by the protective sheath.

The present invention likewise relates to a process for the production of a wound coil of tie material packaged on a display base, comprising the stages consisting in:

(a) spreading out and heating a thin plastic film in order to tension and soften it, (b) placing facing the film a porous substrate on which is laid at least one wound coil of tie material with the end of the tie material on the inside of the coil slightly brought out and shaped to project in the direction of the film, (c) applying the plastic sheath to the substrate and exerting suction from beneath the substrate in order thus to cause the plastic sheath to conform to the shape of the coil and to bond the sheath to the substrate, this operation having at the same time the effect that the end of the tie material transpierces the film and thus becomes accessible.

According to another aspect of the process of the invention, there is disposed on the substrate, at the side of the wound coil of tie material, a cutting tool which at the end of stage (c) is completely covered by the film and fixed on the substrate without it being necessary to provide additional fastening means.

In the process of the present invention, provision is made for example for the end of the innermost turn to be bent out over at least about 5 to 10 mm in the course of the execution of stage (c), this end of the innermost turn being bent out into a horizontal position relative to the substrate or else being bent out into a vertical position relative to the said substrate.

The substrate used in the process of the invention is of any type, selected to serve as a display base and also to permit the passage of air when suction is applied. Cardboard is suitable for this purpose.

It is important to choose a film of thermoplastic material sufficiently thin to conform to all the contours of the objects disposed on the substrate (coil and, optionally, cutting tool), while allowing the end of the innermost turn to transpierce it, which is made easier during the application of the heated, softened film. Moreover, if a cutting tool is disposed on the substrate at the side of the coil, it has been found that the film completely enveloped it without generally being transpierced on the application of the film. For the first utilization it is then sufficient to introduce the unwound tie in the direction of the cutting face of the cutting tool in order to pass through the film and cut off the tie to the desired length. Thus, the film also has a protective action with regard to the cutting tool.

According to the invention, the thin, flexible film conforming to the shape of all the visible faces of the coil serves not only to hold the coil to the substrate but also to permit controlled unwinding of the tie material. This unwinding is not disorderly as in previous devices. In the packaged bobbin according to the invention, the wire is unwound regularly and in a controlled manner because of the braking action achieved through the at least partial cooperation between the turns of the coil and the film conforming to its contour.

BRIEF DESCRIPTION OF THE DRAWINGS

Various advantages and characteristics of the present invention will emerge from the detailed description given below with reference to the accompanying drawings, in which.

DESCRIPTION OF PREFERRED EMBODIMENT

Figure 1:
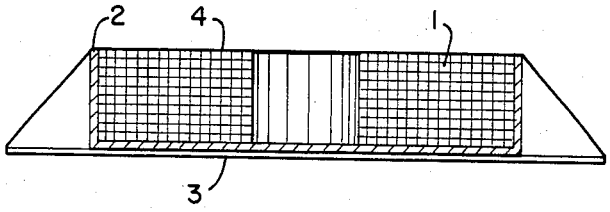
FIG. 1 PRIOR ART
FIG. 1 is a schematic section of a bobbin packaged in accordance with a prior art embodiment.
Figure 2:
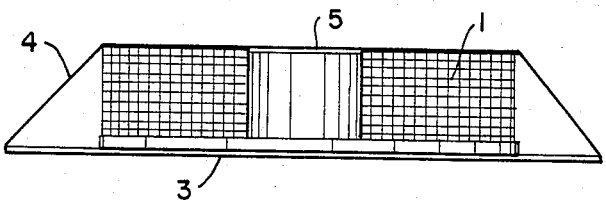
FIG. 2 PRIOR ART
FIG. 2 is a schematic section of a bobbin packaged in accordance with another prior art embodiment.

In the accompanying drawings, FIGS. 1 and 2 show two bobbins packaged in accordance with the prior art. In the arrangement shown in FIG. 1, the bobbin 1 is disposed in a receptacle 2, which is for example a rigid shell of plast1c material. The receptacle 2 is applied to a display card 3. For packaging on the display card 3 a sheath 4 of semirigid plastic material covers the entire arrangement. For the purpose of utilization the sheath 4 must be completely torn off.

The embodiment shown in FIG. 2 is practically equivalent to that shown in FIG. 1, except that the bobbin 1 is not in this case disposed in a receptacle 2 but is held in a cover 5 of plastic material. In this case also the cover 5 rests on a display card 3 and is encapsulated in a semirigid sheath 4, which must be torn off for the purpose of utilization.

Numerous variants of the two embodiments which are described above obviously exist. Thus, the shell of plastic material, whether in the form of the cover 5 or in the form of the receptacle 2, may be faired by a shell of corresponding shape. Finally, the coil of tie material may also be introduced into a spool made entirely of plastic material and riveted to the display card at various points of contact.

The embodiments mentioned above have rigid shells of plastic material, which are expensive to produce. The thickness of the rigid shells generally ranges from 8,000 to 10,000 microns, and the plastic materials used are generally thermosetting plastics. The unwinding of the wire cannot be controlled.

Figure 3:
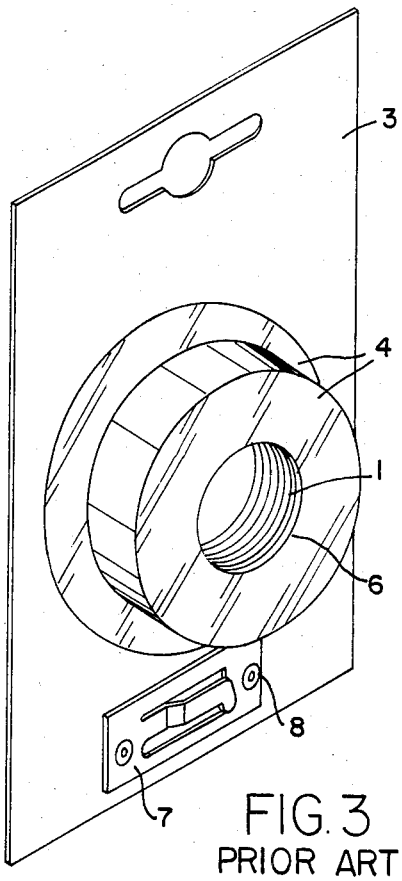
FIG. 3 PRIOR ART
FIG. 3 is a perspective view of a bobbin packaged in accordance with the prior art on a display base with a semirigid sheath of plastic material.

FIG. 3 shows a bobbin 1 packaged with the aid of a semirigid sheath 4, which constitutes another example of a prior art construction.

As is usual, the bobbin 1 is applied to the display card 3. The bobbin 1 is encapsulated by the semi-rigid sheath 4, which is provided with an opening 6 through which the user unwinds the wire. The diameter of the opening 6 corresponds substantially to that of the inner ring of the bobbin 1. In this case the semirigid sheath 4 does not need to be torn off the display card 3, but unwinding is not controlled and the wire tangles and forms kinks. In addition, the cost price of the semirigid sheath 4 is high. Its thickness ranges from 200 to 250 microns. Specialists usually give the name "blister" to a semirigid sheath of this kind.

In this type of packaged bobbin the cutting tool 7 is necessarily riveted to the display card 3 by means of fastening eyelets 8. The cutting tool 7 is situated beneath the bobbin 1. It will readily be realized that the need to rivet the cutting tool 7 to the display card 3 constitutes an additional expensive and disadvantageous operation.

In another arrangement of bobbins packaged with the aid of a blister, which is not illustrated in the accompanying drawings, the semirigid sheath is not provided with an opening but encapsulates the entire top face of the bobbin, and the wire is unwound through a hole provided at the rear in the display card. In this case also the unwinding of the wire is inconvenient and leads to the formation of kinks because the tension of the wire is not controlled. Because the wire passes out through the rear face of the display card, it is not possible in this case to provide a cutting tool on the said display card.

The blister in this last-mentioned embodiment of the prior art has a thickness likewise ranging from 200 to 250 microns. The material of which a blister of this kind is composed is generally polyvinyl chloride.

Figure 4:
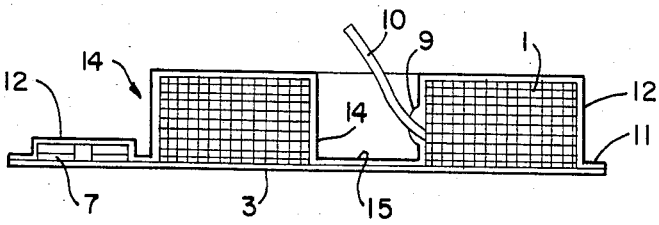
FIG. 4 is a schematic section of the wound coil of tie material according to the present invention, taken along the line IV—IV in FIG. 5.
Figure 5:
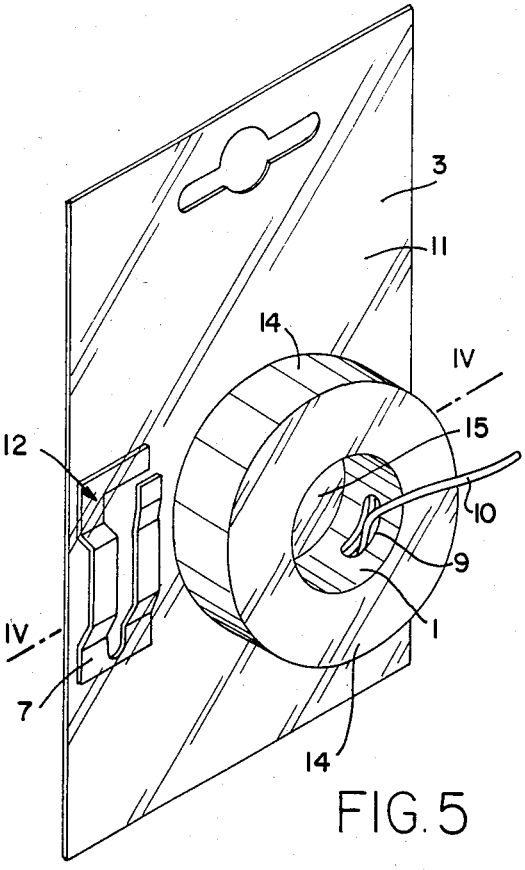
FIG. 5 is a perspective view of the bobbin packaged in accordance with the present invention.

In the bobbin 1 packaged in accordance with the present invention and shown in FIGS. 4 and 5 a thin film 14 envelops and matches the shape of all the visible surfaces of the bobbin 1. It also extends over the display card 3 both in the inner zone 15 of the bobbin and outside side the latter (zone 11). The film 14 has an opening or puncture 9 through which an end 10 of the tie material projects in the upward direction. The film 14 also envelops the cutting tool 7, as indicated at 12, the cutting tool 7 being held by the film 14 on the display card 3. The cutting tool does not need to be riveted to the display card 3, and consequently eyelets are not required.

According to the present invention the film 14 has quite a different structure from that of the blisters of the prior art. It is a very thin film of polyethylene of a thickness of about 80 microns which, as already indicated, is placed both over the entire inner and outer peripheries of the bobbin 1 and over the display card 3.

It can thus be seen that the film 14 matches the shape of all the visible surfaces of the bobbin 1 and at least partially adheres to the turns of the latter. When the end 10 of the tie material is pulled in order to unwind a desired length, the unwinding is thus regular and controlled. The tie material is held by the film 14 in the turns of the bobbin 1.

Because of the above described structure, the bobbin 1 is unwound with controlled tension, turn by turn, and thus no kinking or entangling of the turns is possible.

The cutting tool 7 is also placed against and retained on the display card 3 (zone 12) by the film 14 of plastic material. It can thus be combined with the bobbin 1.

The hole 9 which enables the end of the wire to pass out is formed in a simple manner and automatically, as will be indicated below.

In order to package the bobbin 1 and, if desired , its cutting tool 7 on the display card 3, the following stages are carried out: a thin film 14 of polyethylene of a thickness of about 80 microns is spread out, pulled horizontally and heated by a blast of hot air in order to tension and soften it. A large sheet of porous cardboard, on which are disposed a plurality of coils of tie material together with their respective cutting means, is laid on a table. Substantially 1 centimeter of the end 10 of the innermost turn of each bobbin is bent out, and the table is raised to the level of the thin film of heated polyethylene. The film is applied against the cardboard carrying the bobbins and the cutting means while suction is applied through the lower face of the sheet of cardboard, in such a manner as to cause the film of plastic material to cling and become bonded both to the cardboard and to the assembly comprising the bobbin and its cutting tool. Each bobbin and cutting tool unit mounted on a display base is then separated. During the application of the film of plastic material, the bent out end 10 of the innermost turn will make it possible to form a puncture 9, with the aid of which the tie material will be unwound turn by turn and in a controlled manner.

The cost of a production process of this kind is very advantageous. The polyethylene film conforms perfectly to the contour of each bobbin and adheres well to the substrate through bonding.

According to the invention, it is no longer necessary to make use of thick, expensive films which are difficult to handle, become distorted and which do not permit controlled unwinding, turn by turn, of the packaged product.

Because of the controlled, turn by turn unwinding of the bobbin, it is possible to use the latter to the end without any tangling or kinking occurring, and for the user this is clearly a particularly helpful advantage.

What is claimed is:

1. A process for the production of a wound coil of a tie material packaged on a display base, which comprises the steps of:

(a) spreading out and heating a thin plastic film in order to tension and soften it, (b) placing facing the film a porous substrate on which is laid at least one wound coil of tie material with the end of the tie material on the inside of the coil slightly brought out and shaped to project in the direction of the film, (c) applying the plastic sheath to the substrate and exerting suction from: beneath the substrate in order to cause the plastic sheath to conform to the shape of the coil and to bond the sheath to the substrate, this operation having at the same time the effect that the end of the tie material pierces the film and thus becomes accessible.

2. A process as claimed in claim 1, wherein there is disposed on the substrate, at the side of the wound coil of tie material, a cutting tool which at the end of step (c) is completely covered by the film and fixed on the substrate without it being necessary to provide additional fastening means.

3. A process as claimed in claim 1, wherein in the course of step (c) the end of the innermost turn is bent out over at least about 5 to 10 mm into a horizontal or vertical position relative to the substrate.

4. A process as claimed in claim 1, wherein the substrate is of any type selected to serve as a display base and also to permit the passage of air when suction is applied.

5. A process as claimed in claim 4, wherein the substrate is a porous cardboard.

6. A process as claimed in claim 1 wherein the selected film of thermoplastic material is sufficiently thin to conform to all the contours of the objects disposed on the substrate while allowing the end of the innermost turn to pierce it, during the application of the heated, softened film.

7. A process as claimed in claim 6, wherein the film of plastic material is of polyethylene, for example with a thickness of about 80 microns.

8. A wound coil of tie material packaged on a card-like display base, the coiled tie material being held in place and surrounded by a protective sheath, the improvement comprising:

(a) said sheath consisting of a thin flexible film conforming in shape to all the visible surfaces of said coil and at least partially adhering thereto;

(b) said film continuously covering the entire surface of said card, including the area inside said coil and the area outside said coil;

(c) the only opening in said film being a hole formed therein by the end of said tie material piercing said film, as said tie material is unrolled from the inside of said coil; and (d) means for creating a braking action for controlling the unwinding of said tie material from said coil, said means including the at least partial adherence of said film to said coil.

9. The wound coil of claim 8 further including cutting means for cutting said coiled tie material, said cutting means being held in place on said display base solely by said thin film, so as to position said cutting means on said display base when it is in use.

10. A coil as claimed in claim 8, wherein the film is a plastic material having a thickness of about 80 microns.

11. A coil as claimed in claim 9, wherein the film is a plastic material having a thickness of about 80 microns.

12. A coil as claimed in cliam 8, wherein the film is a polethylene.

13. A coil as claimed in claim 9, wherein the film is a polyethylene.

* * * * *